US010229636B2

(12) United States Patent
Kim et al.

(10) Patent No.: US 10,229,636 B2
(45) Date of Patent: Mar. 12, 2019

(54) PIXEL OF AN ORGANIC LIGHT EMITTING DIODE DISPLAY DEVICE, AND ORGANIC LIGHT EMITTING DIODE DISPLAY DEVICE

(71) Applicant: Samsung Display Co., Ltd., Yongin-si, Gyeonggi-do (KR)

(72) Inventors: Ji-Woong Kim, Suwon-si (KR); Choong-Sun Shin, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 46 days.

(21) Appl. No.: 15/349,847

(22) Filed: Nov. 11, 2016

(65) Prior Publication Data

US 2017/0206836 A1 Jul. 20, 2017

(30) Foreign Application Priority Data

Jan. 18, 2016 (KR) ..... 10-2016-0005724

(51) Int. Cl.
*G09G 3/3233* (2016.01)

(52) U.S. Cl.
CPC ... *G09G 3/3233* (2013.01); *G09G 2300/0842* (2013.01); *G09G 2300/0861* (2013.01); *G09G 2320/0295* (2013.01); *G09G 2320/041* (2013.01); *G09G 2320/045* (2013.01); *G09G 2330/02* (2013.01)

(58) Field of Classification Search
CPC ..... G09G 3/32
See application file for complete search history.

(56) References Cited

U.S. PATENT DOCUMENTS

2009/0179832 A1* 7/2009 Kohno ..... G09G 3/3233 345/76
2012/0139955 A1* 6/2012 Jaffari ..... G06F 17/5018 345/690
2015/0355488 A1* 12/2015 Wang ..... G09G 3/3614 349/37

FOREIGN PATENT DOCUMENTS

KR 10-2010-0094819 A 8/2010
KR 10-2014-0073322 A 6/2014
KR 10-2014-0076061 A 6/2014
KR 10-2014-0092684 A 7/2014
KR 10-2014-0119980 A 10/2014

* cited by examiner

*Primary Examiner* — Joseph R Haley
(74) *Attorney, Agent, or Firm* — Lewis Roca Rothgerber Christie LLP

(57) ABSTRACT

A pixel of an organic light emitting diode (OLED) display device includes a first transistor having a gate connected to a scan line, a first terminal connected to a data line, and a second terminal, a capacitor having a first electrode connected to the second terminal of the first transistor and a second electrode connected to a first power supply voltage, a second transistor having a gate connected to the first electrode of the capacitor, a first terminal connected to the first power supply voltage, and a second terminal, an OLED having an anode connected to the second terminal of the second transistor and a cathode connected to a second power supply voltage, and a third transistor having a gate connected to a first sensing gate line, a first terminal connected to a sensing line, and a second terminal connected to the anode of the OLED.

24 Claims, 15 Drawing Sheets

PIXEL OF AN ORGANIC LIGHT EMITTING DIODE DISPLAY DEVICE, AND ORGANIC LIGHT EMITTING DIODE DISPLAY DEVICE

CROSS-REFERENCE TO RELATED APPLICATION(S)

This application claims priority under 35 USC § 119 to and the benefit of Korean Patent Application No. 10-2016-0005724, filed on Jan. 18, 2016 in the Korean Intellectual Property Office (KIPO), the contents of which are incorporated herein in their entirety by reference.

BACKGROUND OF THE INVENTION

1. Field

Example embodiments of the present invention relate to pixels of organic light emitting diode (OLED) display devices, and the OLED display devices.

2. Description of the Related Art

In an organic light emitting diode (OLED) display device, as time passes, an OLED in each of the pixels tends to degrade, which may generally cause pixel luminance to decrease. To compensate for this pixel degradation, a degradation sensing technique that measures a current flowing through the OLED in response to a voltage applied to the OLED has been developed.

However, even when the pixel degradation is compensated using the degradation sensing technique, the luminance of each pixel may be changed depending on a temperature of the pixel, and thus an image quality of the OLED display device may be deteriorated.

SUMMARY

Some example embodiments provide a pixel of an organic light emitting diode (OLED) display device or an organic light emission display device on which temperature sensing and degradation sensing is performed.

Some example embodiments provide an OLED display device capable of performing temperature sensing and degradation sensing.

According to some example embodiments, there is provided a pixel of an OLED display device including a first transistor having a gate connected to a scan line, a first terminal connected to a data line, and a second terminal, a capacitor having a first electrode connected to the second terminal of the first transistor and a second electrode connected to a first power supply voltage, a second transistor having a gate connected to the first electrode of the capacitor, a first terminal connected to the first power supply voltage, and a second terminal, an OLED having an anode connected to the second terminal of the second transistor and a cathode connected to a second power supply voltage, a third transistor having a gate connected to a first sensing gate line, a first terminal connected to a sensing line, and a second terminal connected to the anode of the OLED, a fourth transistor having a gate connected to a second sensing gate line, a first terminal connected to the sensing line, and a second terminal, and a temperature-dependent element connected to the second terminal of the fourth transistor, a resistance of the temperature-dependent element being changed depending on a temperature of the pixel.

In some example embodiments, the temperature-dependent element may be a temperature-variable resistor of which a resistance increases as the temperature of the pixel increases.

In some example embodiments, the temperature-dependent element may be a temperature-dependent transistor of which a turn-on resistance increases as the temperature of the pixel increases.

In some example embodiments, the fourth transistor may be turned on in response to a second sensing gate signal applied through the second sensing gate line, and while the fourth transistor is turned on a current flowing through the temperature-dependent element based on a temperature sensing voltage may be applied to the sensing line to be measured during a temperature sensing period.

In some example embodiments, a magnitude of the current flowing through the temperature-dependent element may depend on a temperature of the pixel.

In some example embodiments, the temperature sensing period may be in an emission period of a display frame.

In some example embodiments, the temperature sensing period may be in a sensing period separate from a display period.

In some example embodiments, the third transistor may be turned on in response to a first sensing gate signal applied through the first sensing gate line, and while the third transistor is turned on during a degradation period a current flowing through the OLED may be applied to the sensing line to be measured.

In some example embodiments, a magnitude of the current flowing through the OLED may depend on a degree of degradation of the pixel.

In some example embodiments, the degradation sensing period may be in an emission period of a display frame.

In some example embodiments, the degradation sensing period may be in a sensing period separate from a display period.

In some example embodiments, the data line and the sensing line may be different lines extending in parallel with each other.

In some example embodiments, the data line and the sensing line may be the same line.

In some example embodiments, the second transistor may be turned off when a black data voltage, applied to the data line, is stored in the capacitor through the first transistor in a sensing period.

In some example embodiments, the fourth transistor may provide a temperature sensing voltage, applied to the sensing line, to the temperature-dependent element during a temperature sensing period within the sensing period, and a current flowing through the temperature-dependent element, based on the temperature sensing voltage, may be applied to the sensing line to be measured.

In some example embodiments, the third transistor may provide a degradation sensing voltage, applied to the sensing line, to the OLED during a degradation sensing period within the sensing period, and a current flowing through the OLED, based on the degradation sensing voltage, may be applied to the sensing line to be measured.

In some example embodiments, at least one of the first power supply voltage or the second power supply voltage may be adjusted such that the first power supply voltage and the second power supply voltage have substantially the same voltage level during a sensing period.

In some example embodiments, the pixel may further include a fifth transistor having a gate for receiving an emission control signal, a first terminal connected to the second terminal of the second transistor, and a second terminal connected to the anode of the OLED.

In some example embodiments, the fifth transistor may be turned off in response to the emission control signal having a set voltage level during a sensing period.

According to some example embodiments, there is provided an OLED display device including a plurality of pixels. At least one pixel of the plurality of pixels includes a first transistor having a gate connected to a scan line, a first terminal connected to a data line, and a second terminal, a capacitor having a first electrode connected to the second terminal of the first transistor and a second electrode connected to a first power supply voltage, a second transistor having a gate connected to the first electrode of the capacitor, a first terminal connected to the first power supply voltage, and a second terminal, an OLED having an anode connected to the second terminal of the second transistor and a cathode connected to a second power supply voltage, a third transistor having a gate connected to a first sensing gate line, a first terminal connected to a sensing line, and a second terminal connected to the anode of the OLED, a fourth transistor having a gate connected to a second sensing gate line, a first terminal connected to the sensing line, and a second terminal, and a temperature-dependent element connected to the second terminal of the fourth transistor, a resistance of the temperature-dependent element being changed depending on a temperature of the at least one pixel.

In some example embodiments, a portion of the plurality of pixels may include the temperature-dependent element.

In some example embodiments, the OLED display device may further include a sensing circuit configured to sense a degree of degradation of the at least one pixel by measuring a current flowing through the OLED and to sense the temperature of the at least one pixel by measuring a current flowing through the temperature-dependent element.

In some example embodiments, the sensing circuit may adjust image data for the at least one pixel based on the sensed degree of degradation and the sensed temperature to compensate for the degradation and the temperature of the at least one pixel.

In some example embodiments, the plurality of pixels may be grouped into a plurality of pixel groups, and one of the plurality of pixels in each of the pixel groups may include the temperature-dependent element.

In some example embodiments, the plurality of pixels may be grouped into a plurality of pixel groups, and a temperature sensing operation for the plurality of pixels in each of the pixel groups may be concurrently performed.

In some example embodiments, a temperature sensing operation may be performed for a portion of the plurality of pixels when image data for the plurality of pixels has the same gray level.

As described above, in the pixel of the OLED display device according to example embodiments, the degradation of the pixel may be sensed and the temperature of the pixel may be sensed using the temperature-dependent element, thereby an accurate degradation and temperature compensation may be performed.

Further, the OLED display device according to example embodiments may sense the degradation of each pixel included in the OLED display device and also sense the temperature of each pixel using the temperature-dependent element included in each pixel, thereby an accurate degradation and temperature compensation may be performed for each pixel.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
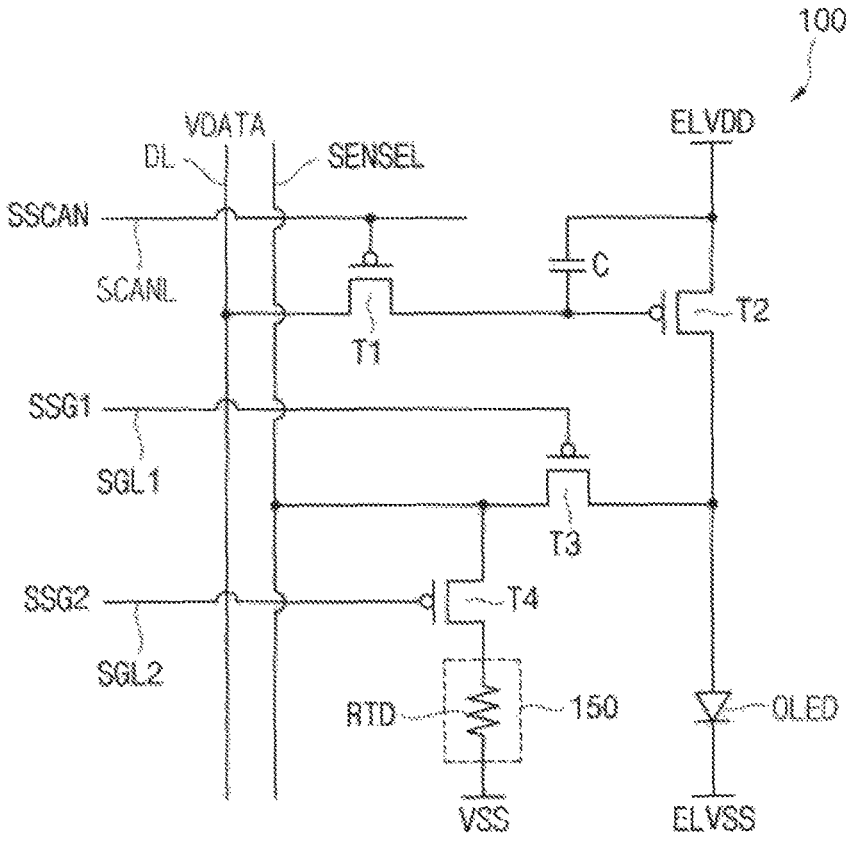
FIG. 1 is a circuit diagram illustrating a pixel of an organic light emitting diode (OLED) display device according to example embodiments.

The example embodiments are described more fully hereinafter with reference to the accompanying drawings. Like or similar reference numerals refer to like or similar elements throughout.

It will be understood that, although the terms "first," "second," "third," etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section, without departing from the spirit and scope of the present invention.

Further, it will also be understood that when one element, component, region, layer, and/or section is referred to as being "between" two elements, components, regions, layers, and/or sections, it can be the only element, component, region, layer, and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," "one of," and "selected from," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Furthermore, "connection," "connected," etc., may also refer to "electrical connection," "electrically connected," etc., depending on the context in which such terms are used as would be understood by those skilled in the art. When an element or layer is referred to as being "directly on," "directly connected to," "directly coupled to," "directly connected with," "directly coupled with," or "immediately adjacent to" another element or layer, there are no intervening elements or layers present.

As used herein, "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

Features described in relation to one or more embodiments of the present invention are available for use in conjunction with features of other embodiments of the present invention. For example, features described in a first embodiment may be combined with features described in a second embodiment to form a third embodiment, even though the third embodiment may not be specifically described herein.

Figure 2:
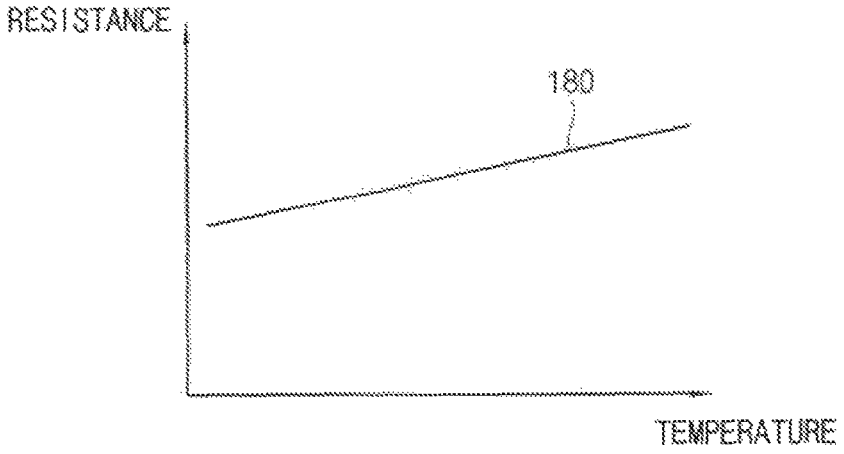
FIG. 2 is a graph illustrating a resistance characteristic of a temperature-variable resistor included in the pixel of FIG. 1 based on a temperature at the temperature-variable resistor.
Figure 3:
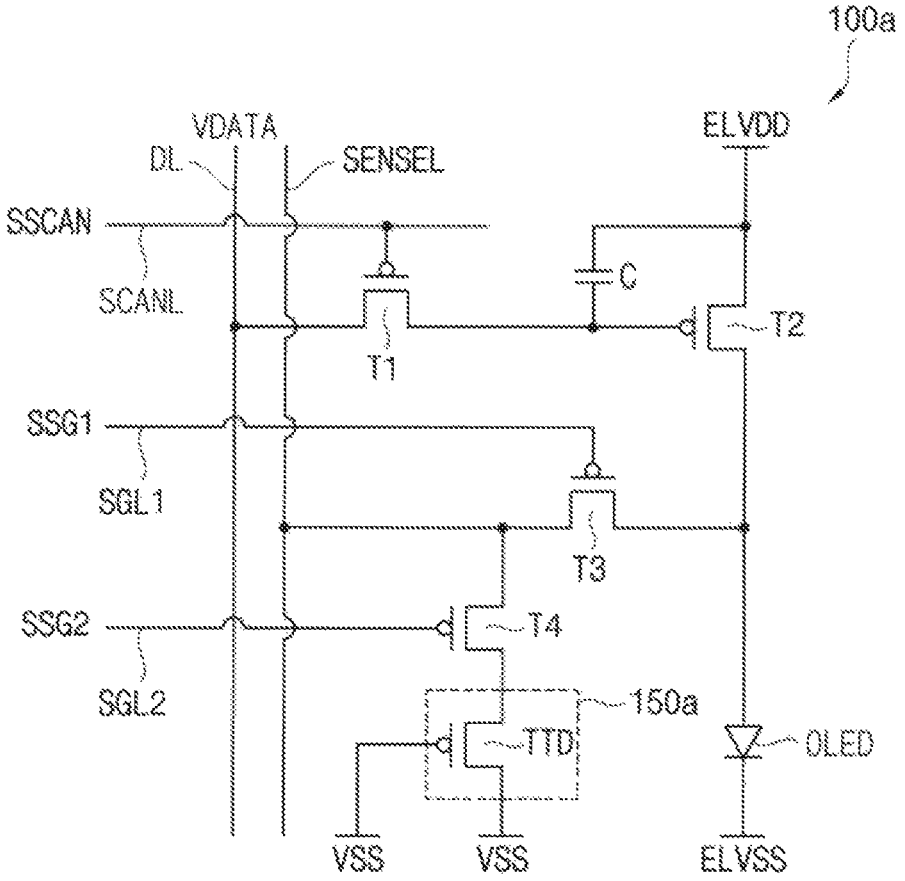
FIG. 3 is a circuit diagram illustrating a pixel of an OLED display device according to example embodiments.
Figure 4:
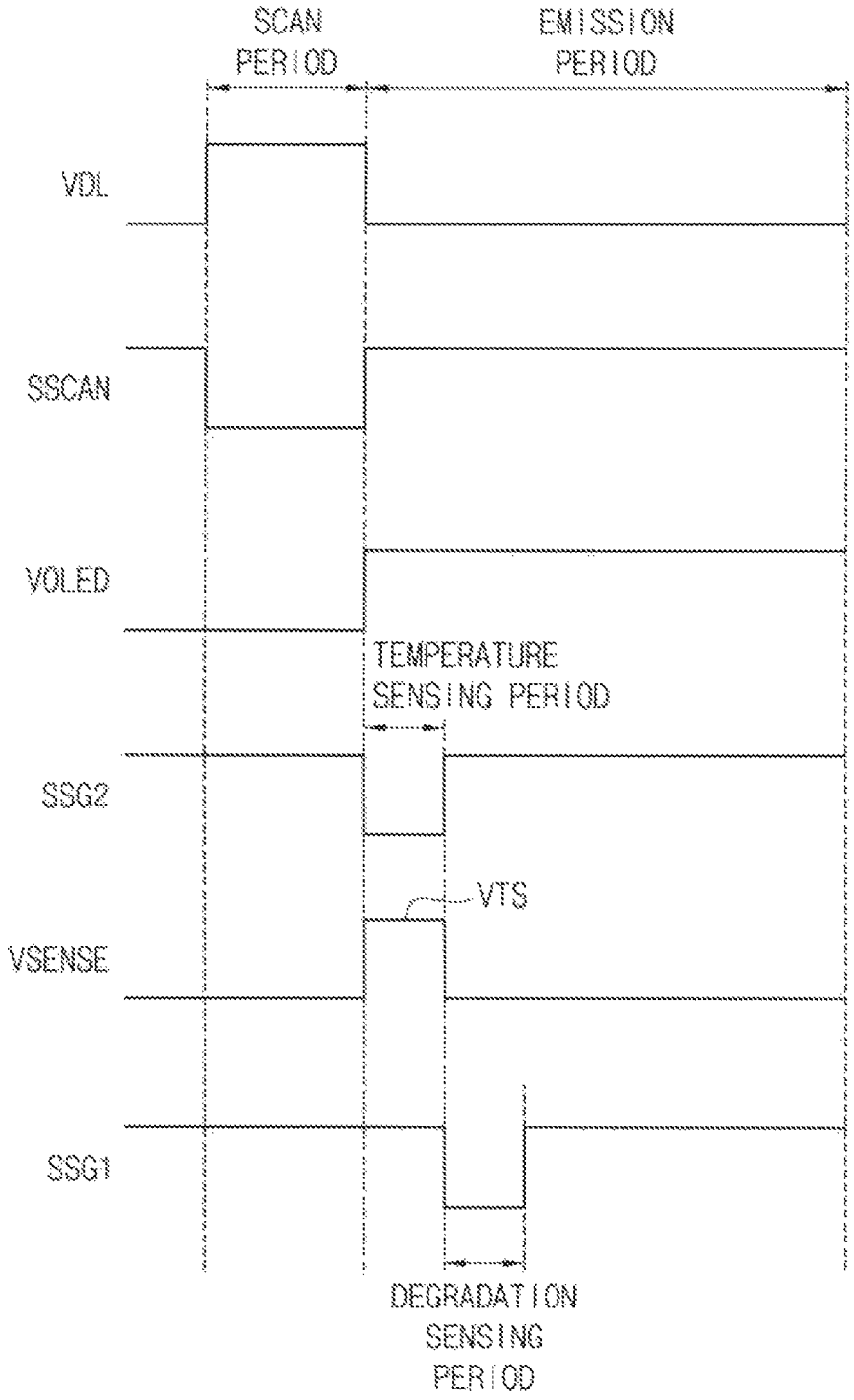
FIG. 4 is a timing diagram for illustrating an example of an operation of the pixel illustrated in FIG. 1 or the pixel illustrated in FIG. 3.

FIG. 1 is a circuit diagram illustrating a pixel of an organic light emitting diode (OLED) display device according to example embodiments, FIG. 2 is a graph illustrating a resistance characteristic of a temperature-variable resistor included in the pixel of FIG. 1 based on a temperature at the temperature-variable resistor, FIG. 3 is a circuit diagram illustrating a pixel of an OLED display device according to example embodiments, and FIG. 4 is a timing diagram for illustrating an example of an operation of the pixel illustrated in FIG. 1 or the pixel illustrated in FIG. 3.

Referring to FIG. 1, a pixel 100 of an organic light emitting diode (OLED) display device according to example embodiments includes a first transistor T1, a capacitor C, a second transistor T2, an OLED, a third transistor T3, a fourth transistor T4, and a temperature-dependent element 150.

The first transistor T1 may have a gate connected to a scan line SCANL, a first terminal connected to a data line DL, and a second terminal connected to the capacitor C. The first transistor T1 may transfer a voltage (e.g., a data voltage VDATA) applied to the data line DL to the capacitor C in response to a scan signal SSCAN applied to the scan line SCANL.

The capacitor C may have a first electrode connected to the second terminal of the first transistor T1 and a second electrode connected to a first power supply voltage ELVDD (e.g., a high power supply voltage). The capacitor C may store the voltage (e.g., the data voltage VDATA) transferred by the first transistor T1.

The second transistor T2 may have a gate connected to the first electrode of the capacitor C, a first terminal connected to the first power supply voltage ELVDD, and a second terminal. The second transistor T2 may generate a driving current based on the voltage stored in the capacitor C.

The OLED may have an anode connected to the second terminal of the second transistor T2 and a cathode connected to a second power supply voltage ELVSS (e.g., a first low power supply voltage). The OLED may emit light based on the driving current generated by the second transistor T2.

The third transistor T3 may have a gate connected to a first sensing gate line SGL1, a first terminal connected to a sensing line SENSEL, and a second terminal connected to the anode of the OLED. In a degradation sensing period, the third transistor T3 may be turned on in response to a first sensing gate signal SSG1 applied through the first sensing gate line SGL1. While the third transistor T3 is turned on, a current flowing through the OLED based on a voltage applied to the anode of the OLED through the sensing line SENSEL or through the turned-on second transistor T2 may be measured. By measuring the current generated by the voltage applied to the OLED, a degree of degradation of the OLED or the pixel 100 may be determined. This operation may be referred to as a degradation sensing operation.

In some example embodiments, the degradation sensing period during which the degradation sensing operation is performed may be included in an emission period of a display frame. That is, while the OLED display device displays a desired image, or while the OLED emits light based on the data voltage VDATA, the degradation sensing operation may be performed.

In other example embodiments, the degradation sensing period may be included in a sensing period separate from a display period including at least one display frame. That is, while the OLED display device does not display an image, or while the driving current generated by the second transistor T2 is not provided to the OLED, the degradation sensing operation may be performed. For example, the degradation sensing operation may be performed when the OLED display device is powered on, or when the OLED display device is in a standby state. Further, the degradation sensing operation may be performed with a set period (e.g., a predetermined period) or with an arbitrary interval.

The OLED display device may adjust image data or the data voltage VDATA for the pixel 100 to compensate for the sensed degradation of the pixel 100. For example, when the degree of degradation of the pixel 100 is increased, the OLED display device may increase the image data or the data voltage VDATA for the pixel 100 (or may decrease the image data or the data voltage VDATA in a case in which the second transistor T2 is a PMOS transistor).

The fourth transistor T4 may have a gate connected to a second sensing gate line SGL2, a first terminal connected to the sensing line SENSEL, and a second terminal connected to the temperature-dependent element 150. The fourth transistor T4 may be turned on in response to a second sensing gate signal SSG2 applied through the second sensing gate line SGL2 to connect the sensing line SENSEL to the temperature-dependent element 150.

The temperature-dependent element 150 may be connected between the second terminal of the fourth transistor T4 and a third power supply voltage VSS (e.g., a second low power supply voltage). According to example embodiments, the second power supply voltage ELVSS and the third power supply voltage VSS may be the same power supply voltage, or they may be different power supply voltages. A resistance of the temperature-dependent element 150 may be changed depending on a temperature of the pixel 100. In some example embodiments, the resistance of the temperature-dependent element 150 may increase as the temperature increases. For example, the resistance of the temperature-dependent element 150 may be linearly or exponentially proportional to the temperature. In other example embodiments, the resistance of the temperature-dependent element 150 may decrease as the temperature increases. For example, the resistance of the temperature-dependent element 150 may be linearly or exponentially inverse proportional to the temperature.

In some example embodiments, as illustrated in FIG. 1, the temperature-dependent element 150 may be implemented with a temperature-variable resistor RTD. For example, as illustrated in FIG. 2, the resistance 180 of the temperature-variable resistor RTD may increase as the temperature increases.

Referring to FIG. 3, a pixel 100*a* of an OLED display device according to example embodiments may include a temperature-dependent transistor TTD as a temperature-dependent element 150*a*. The third power supply voltage VSS may be applied to a gate of the temperature-dependent transistor TTD, and thus the temperature-dependent transistor TTD may be turned on. For example, a turn-on resistance of the temperature-dependent transistor TTD may increase as the temperature increases.

Referring again to FIG. 1, in a temperature sensing period, the fourth transistor T4 may be turned on in response to the second sensing gate signal SSG2 applied through the second sensing gate line SGL2. While the fourth transistor T4 is turned on, a temperature sensing voltage may be applied to the temperature-dependent element 150 through the sensing line SENSEL, and a current may flow through the temperature-dependent element 150 based on the temperature sensing voltage. The current flowing through the temperature-dependent element 150 may be measured, the resistance of the temperature-dependent element 150 may be determined based on the measured current, and the temperature of the pixel 100 may be determined based on the determined resistance. This operation may be referred to as a temperature sensing operation.

In some example embodiments, the temperature sensing period during which the temperature sensing operation is performed may be included in the emission period of the display frame. That is, while the OLED display device displays a desired image, or while the OLED emits light based on the data voltage VDATA, the temperature sensing operation may be performed.

In other example embodiments, the temperature sensing period may be included in the sensing period separate from the display period including at least one display frame. That is, while the OLED display device does not display an image, or while the driving current generated by the second transistor T2 is not provided to the OLED, the temperature sensing operation may be performed. For example, the temperature sensing operation may be performed when the OLED display device is powered on, or when the OLED display device is in the standby state. Further, the temperature sensing operation may be performed with a set period (e.g., a predetermined period) or with an arbitrary interval.

The OLED display device may adjust image data or the data voltage VDATA for the pixel 100 to compensate for a luminance change depending on the temperature of the pixel 100. For example, when the temperature of the pixel 100 is increased, the OLED display device may increase the image data or the data voltage VDATA for the pixel 100 (or may decrease the image data or the data voltage VDATA in a case in which the second transistor T2 is a PMOS transistor).

As described above, in the pixel 100 of the OLED display device according to example embodiments, the degradation of the pixel 100 or the OLED may be sensed by measuring the current flowing through the OLED and the third transistor T3 and the temperature of the pixel 100 may be sensed using the temperature-dependent element 150 included in the pixel 100. Accordingly, an accurate degradation and temperature compensation may be performed, and an image quality of the OLED display device may be improved.

Figure 5:
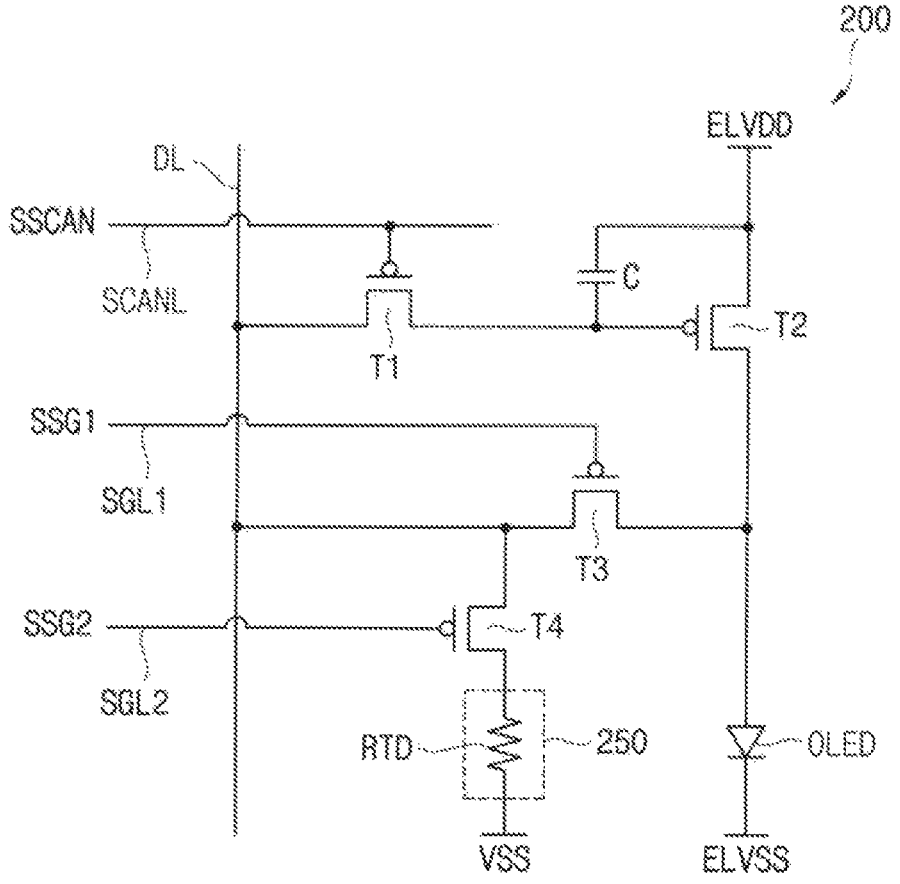
FIG. 5 is a circuit diagram illustrating a pixel of an OLED display device according to example embodiments.

Although FIG. 1 illustrates an example where the data line DL and the sensing line SENSEL are different lines extending in parallel with each other, in some example embodiments, as illustrated in FIG. 5, the data line DL and the sensing line SENSEL may be the same line. In other example embodiments, the pixel 100 may be further connected to an additional sensing line, and the third transistor T3 and the fourth transistor T4 may be connected to the sensing line SENSEL and the additional sensing line, respectively.

Further, although FIG. 1 illustrates an example where the scan line SCANL, the first sensing gate line SGL1, and the second sensing gate line SGL2 are separate lines, in some example embodiments, at least one of the first sensing gate line SGL1 and the second sensing gate line SGL2 for the pixel 100 in a first row may be a scan line for another pixel in a second row adjacent to the first row. For example, at least one of the first and second sensing gate lines SGL1 and SGL2 may be a scan line in the second row.

Although FIG. 1 illustrates an example where the first through fourth transistors T1, T2, T3, and T4 are PMOS transistors, in some example embodiments, the first through fourth transistors T1, T2, T3, and T4 may be implemented with NMOS transistors.

An example of an operation of the pixel 100 of the OLED display device according to example embodiments will be described below with reference to FIGS. 1 through 4.

In a scan period, the data voltage VDATA may be applied as a data line voltage VDL to the data line DL, and the scan signal SSCAN having a low level may be applied to the scan line SCANL. The first transistor T1 may transfer the data voltage VDATA from the data line DL to the capacitor C in response to the scan signal SSCAN having the low level. The capacitor C may store the data voltage VDATA transferred by the first transistor T1.

In the emission period (or a light-emission period), the second transistor T2 may be turned on in response to the data voltage VDATA stored in the capacitor C. A voltage VOLED between the anode and the cathode of the OLED may be increased by the turned-on second transistor T2, and the OLED may emit light based on the increased voltage VOLED. In some example embodiments, the emission period may include the temperature sensing period and the degradation sensing period.

In the temperature sensing period within the emission period, the temperature sensing voltage VTS may be applied as a sensing line voltage VSENSE to the sensing line SENSEL, and the second sensing gate signal SSG2 having a low level may be applied to the second sensing gate line SGL2. The fourth transistor T4 may be turned on in response to the second sensing gate signal SSG2 having the low level, the turned-on fourth transistor T4 may connect the sensing line SENSEL to the temperature-dependent element 150, and thus a current may flow through the temperature-dependent element 150 based on the temperature sensing voltage VTS. The current flowing through the temperature-dependent element 150 based on the temperature sensing voltage VTS may be measured through the sensing line SENSEL. Based on this measured current, the resistance of the temperature-dependent element 150 may be determined, and the temperature of the pixel 100 may be determined based on the resistance.

In the degradation sensing period within the emission period, the first sensing gate signal SSG1 having a low level may be applied to the first sensing gate line SGL1. The third transistor T3 may be turned on in response to the first sensing gate signal SSG1 having the low level, the turned-on third transistor T3 may connect the sensing line SENSEL to the OLED, and thus a current flowing through the OLED based on the voltage VOLED applied to the OLED through the turned-on second transistor T2 may be measured through the third transistor T3 and the sensing line SENSEL. Based on this measured current, the degree of degradation of the pixel 100 or the OLED may be determined.

As described above, because the temperature of the pixel as well as the degradation of the pixel 100 is sensed, the accurate degradation and temperature compensation may be performed, and the image quality of the OLED display device may be improved.

Although FIG. 4 illustrates an example where the temperature sensing operation is performed before the degradation sensing operation is performed, in some example embodiments, the temperature sensing operation may be performed after the degradation sensing operation is performed.

Figure 6:
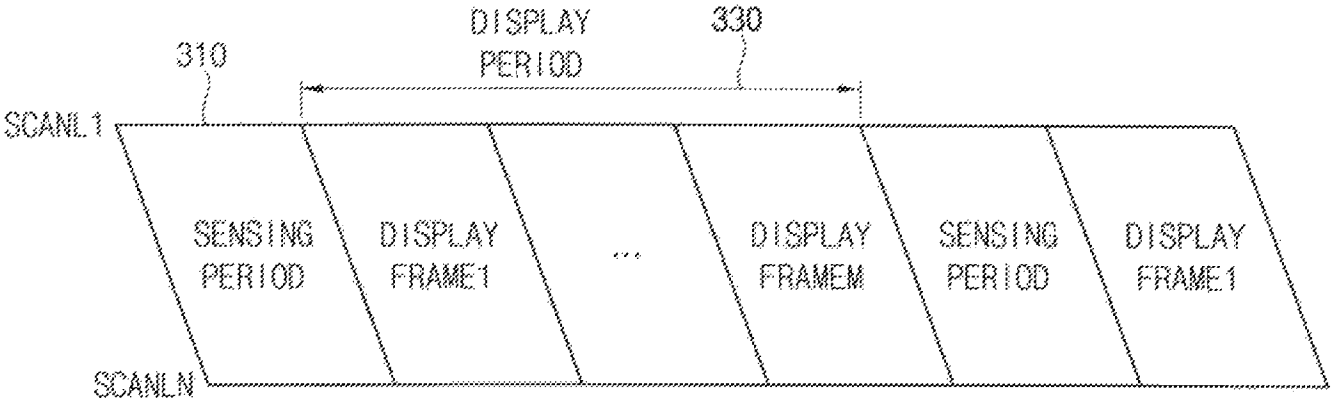
FIG. 6 is a diagram illustrating an example of a sensing period and a display period for an OLED display device according to example embodiments.
Figure 7:
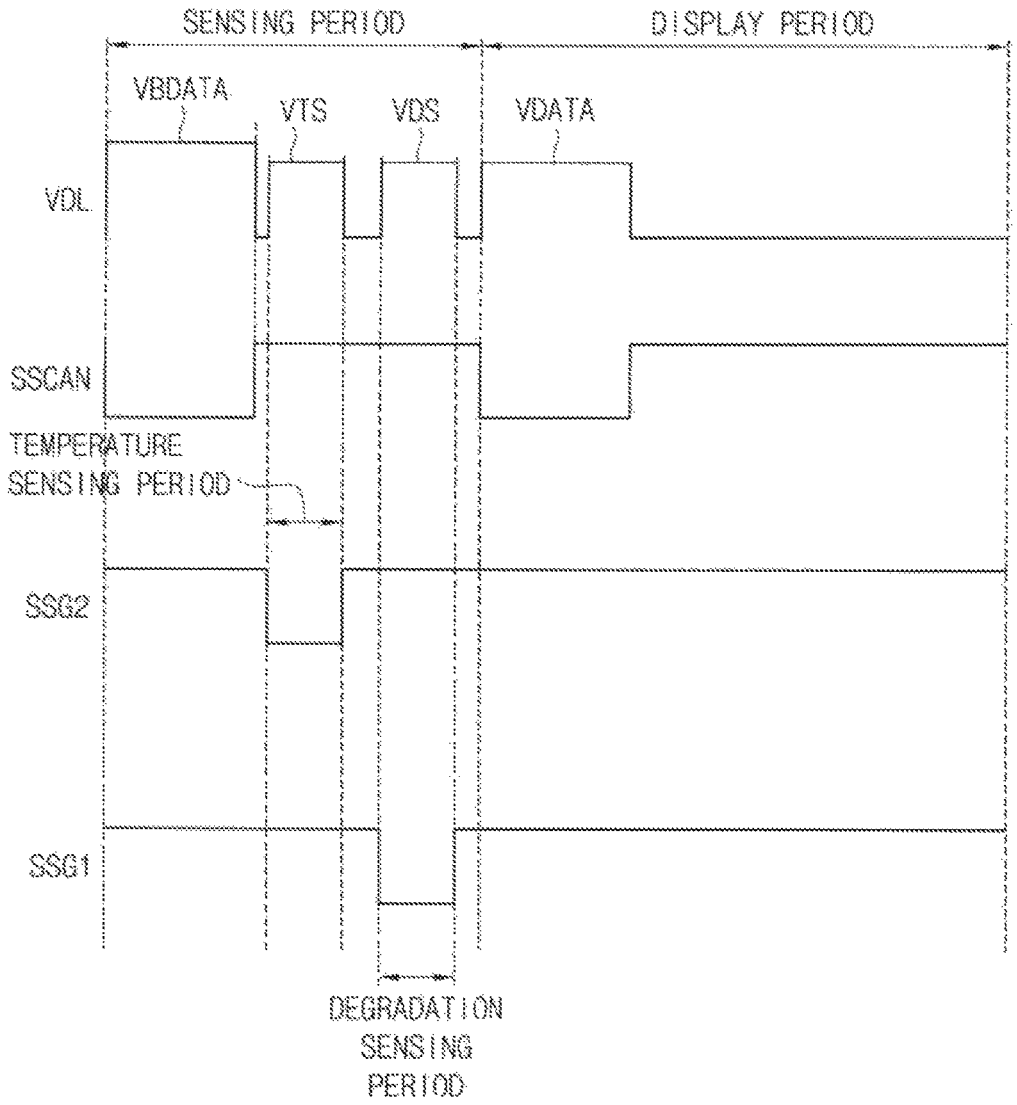
FIG. 7 is a timing diagram for illustrating an example of an operation of the pixel illustrated in FIG. 5.

FIG. 5 is a circuit diagram illustrating a pixel of an OLED display device according to example embodiments, FIG. 6 is a diagram illustrating an example of a sensing period and a display period for an OLED display device according to example embodiments, and FIG. 7 is a timing diagram for illustrating an example of an operation of the pixel illustrated in FIG. 5.

Referring to FIG. 5, a pixel 200 of an OLED display device according to example embodiments includes a first transistor T1, a capacitor C, a second transistor T2, an OLED, a third transistor T3, a fourth transistor T4, and a temperature-dependent element 250. The temperature-dependent element 250 may be implemented with a temperature-variable resistor RTD. The pixel 200 of FIG. 5 may have a similar configuration to the pixel 100 of FIG. 1, except that a data line DL is used as a sensing line.

In the pixel 200 of FIG. 5, unlike the pixel of FIG. 1 where third and fourth transistors T3 and T4 are connected to a sensing line SENSEL, the third and fourth transistors T3 and T4 may be connected to the data line DL. That is, the third transistor T3 may have a gate connected to a first sensing gate line SGL1, a first terminal connected to the data line DL, and a second terminal connected to an anode of the OLED, and the fourth transistor T4 may have a gate connected to a second sensing gate line SGL2, a first terminal connected to the data line DL, and a second terminal connected to the temperature-dependent element 250. In this case, the data line DL may serve as the sensing line SENSEL illustrated in FIG. 1.

Hereinafter, an example of an operation of the pixel 200 will be described below with reference to FIGS. 5 through 7.

As illustrated in FIG. 6, the OLED display device according to example embodiments may have a sensing period 310 during which a degree of degradation and a temperature of the pixel 200 are sensed, and a display period 330 during which a desired image is displayed. For example, in the sensing period 310, degradation and temperature sensing operations for pixels included in the OLED display device may be sequentially performed from the pixels connected to a first scan line SCANL1 to the pixels connected to an Nth scan line SCANLN. In the display period 330, the pixels of the OLED display device may emit light based on image data in which sensed degradation and temperature are compensated. Although FIG. 6 illustrates an example where there is one sensing period 310 per M display frames (DISPLAY FRAME1 to DISPLAY FRAMEM), the sensing period 310 may be located at arbitrary time points before or when the OLED display device operates. For example, the sensing period 310 may be located at a time of power-on of the OLED display device, or may be located when the OLED display device is in a standby state, or may be located with a set period (e.g., a predetermined period) or with an arbitrary interval.

In some example embodiments, as illustrated in FIG. 7, in the sensing period 310, a black data voltage VBDATA (e.g., a voltage having substantially the same voltage level as a first power supply voltage ELVDD) may be applied as a data line voltage VDL to the data line DL, and the first transistor T1 may be turned on in response to a scan signal SSCAN having a low level. Thus, the black data voltage VBDATA may be stored in the capacitor C, and the second transistor T2 may be turned off in response to the black data voltage VBDATA stored in the capacitor C during the sensing period 310.

After the black data voltage VBDATA is stored in the capacitor C, in a temperature sensing period within the sensing period 310, a temperature sensing voltage VTS may be applied to the data line DL, and the fourth transistor T4 may be turned on in response to a second sensing gate signal SSG2 having a low level to connect the data line DL to the temperature-dependent element 250. Accordingly, in the temperature sensing period, the temperature sensing voltage VTS applied to the data line DL may be provided to the temperature-dependent element 250 through the fourth transistor T4, and a current flowing through the temperature-dependent element 250 based on the temperature sensing voltage VTS may be measured. A resistance of the temperature-dependent element 250 may be determined based on the measured current, and the temperature of the pixel 200 may be determined based on the determined resistance.

In a degradation sensing period within the sensing period 310, a degradation sensing voltage VDS may be applied to the data line DL, and the third transistor T3 may be turned on in response to a first sensing gate signal SSG1 having a low level to connect the data line DL to the OLED. Accordingly, in the degradation sensing period, the degradation sensing voltage VDS applied to the data line DL may be provided to the OLED through the third transistor T3, and a current flowing through the OLED based on the degradation sensing voltage VDS may be measured. A degree of degradation of the pixel 200 or the OLED of the pixel 200 may be determined based on the measured current.

Thus, the temperature as well as the degradation of the pixel 200 may be sensed in the sensing period 310. Further, in the display period 330 after the sensing period 310, a data voltage VDATA applied to the pixel 200 may be adjusted to compensate for the sensed degradation and to further compensate for a luminance change depending on the sensed temperature. In the display period 330, the degradation and temperature compensated data voltage VDATA may be applied to the data line DL, and the first transistor T1 may store the degradation and temperature compensated data voltage VDATA in the capacitor C in response to the scan signal having the low level. The second transistor T2 may generate a driving current based on the degradation and temperature compensated data voltage VDATA stored in the capacitor C, and the OLED may emit light based on the driving current corresponding to the degradation and temperature compensated data voltage VDATA. Accordingly, the pixel 200 may have a desired luminance, and thus an image quality of the OLED display device may be improved.

As described above, in the pixel 200 of the OLED display device according to example embodiments, the temperature of the pixel 200 as well as the degradation of the pixel 200 may be sensed in the sensing period 310, and the pixel 200 may emit light based on the data voltage VDATA in which the degradation and temperature are compensated based on the sensed degradation and temperature in the display period 330. Thus, an accurate degradation and temperature compensation may be performed by sensing the temperature as well as the degradation of the pixel 200, and the image quality of the OLED display device may be improved. Further, the data line DL may serve as the sensing line for voltage applying and/or current sensing, and the number of lines of the OLED display device may be reduced.

Figure 8:
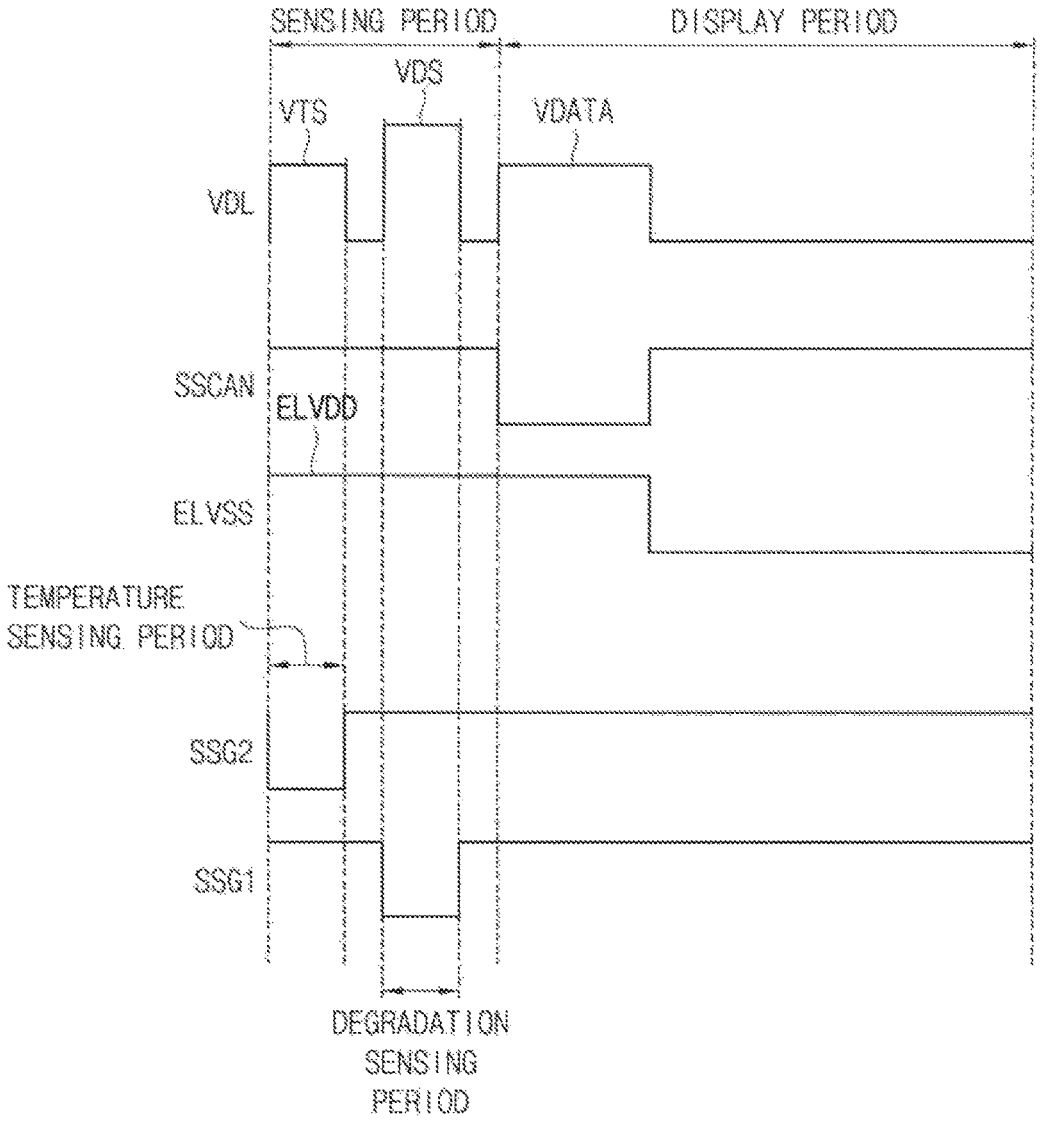
FIG. 8 is a timing diagram for illustrating another example of an operation of the pixel illustrated in FIG. 5.

FIG. 8 is a timing diagram for illustrating another example of an operation of the pixel illustrated in FIG. 5.

Referring to FIGS. 5 and 8, at least one of a first power supply voltage ELVDD or a second power supply voltage ELVSS may be adjusted such that the first power supply voltage ELVDD and the second power supply voltage ELVSS have substantially the same voltage level during a sensing period. For example, as illustrated in FIG. 8, during the sensing period, the second power supply voltage ELVSS may be increased to have substantially the same voltage level as the first power supply voltage ELVDD. Accordingly, a current path through a second transistor T2 may not be formed, and a degradation sensing operation and a temperature sensing operation may be accurately performed. An operation of the pixel 200 illustrated in FIG. 8 may be similar to an operation of the pixel 200 described with reference to FIG. 7, except that the second power supply voltage ELVSS is increased instead of applying a black data voltage VBDATA to the pixel 200 in the sensing period.

In a temperature sensing period within the sensing period, a temperature sensing voltage VTS applied to a data line DL may be provided to a temperature-dependent element 250 through a fourth transistor T4, and a current flowing through the temperature-dependent element 250 based on the temperature sensing voltage VTS may be measured through the data line DL. Further, in a degradation sensing period within the sensing period, a degradation sensing voltage VDS applied to the data line DL may be provided to an OLED through a third transistor T3, and a current flowing through the OLED based on the degradation sensing voltage VDS may be measured through the data line DL. In some example embodiments, the degradation sensing voltage VDS may be higher than the first power supply voltage ELVDD. In a display period after the sensing period, the pixel 200 may emit light based on a data voltage VDATA in which the sensed degradation and temperature are compensated. Accordingly, the pixel 200 may have a desired luminance, and thus an image quality of the OLED display device may be improved.

Figure 9:
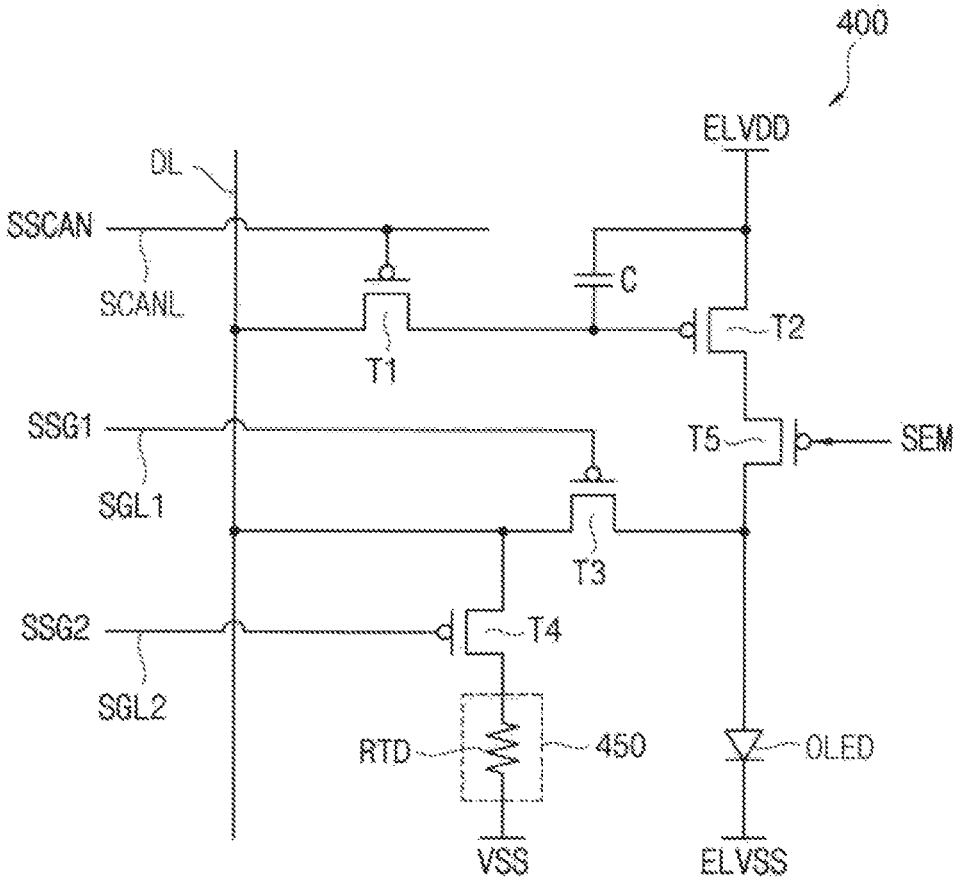
FIG. 9 is a circuit diagram illustrating a pixel of an OLED display device according to example embodiments.
Figure 10:
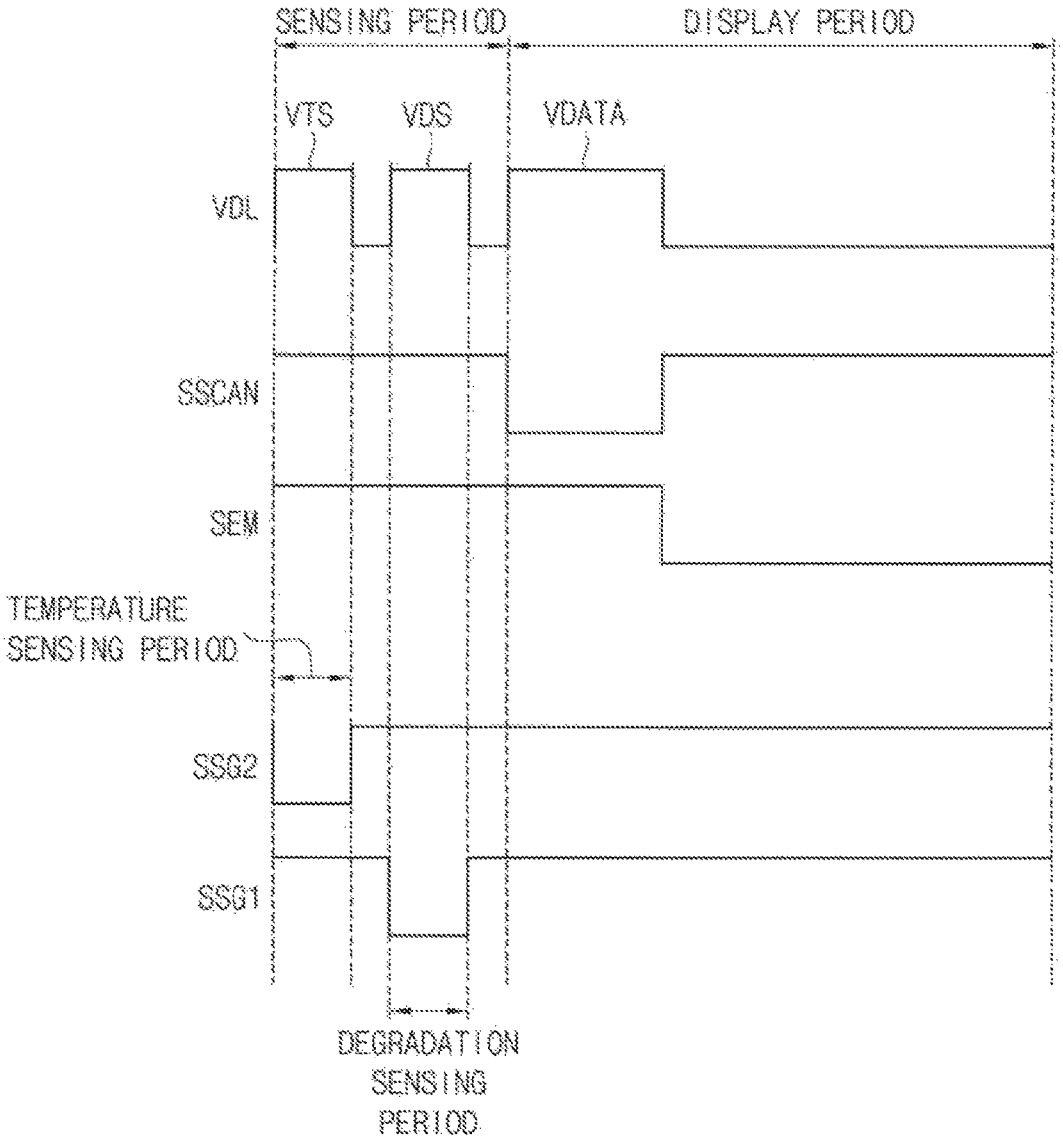
FIG. 10 is a timing diagram for illustrating an example of an operation of the pixel illustrated in FIG. 9.

FIG. 9 is a circuit diagram illustrating a pixel of an OLED display device according to example embodiments, and FIG. 10 is a timing diagram for illustrating an example of an operation of the pixel illustrated in FIG. 9.

Referring to FIG. 9, a pixel 400 of an OLED display device according to example embodiments includes a first transistor T1, a capacitor C, a second transistor T2, an OLED, a third transistor T3, a fourth transistor T4, a temperature-dependent element 450, and a fifth transistor T5 connected between the second transistor T2 and the OLED. The temperature-dependent element 450 may be implemented with a temperature-variable resistor RTD. The pixel 400 of FIG. 9 may have a similar configuration to a pixel 200 of FIG. 5, except that the pixel 400 may further include the fifth transistor T5.

The fifth transistor T5 may have a gate for receiving an emission control signal SEM, a first terminal connected to a second terminal of the second transistor T2, and a second terminal connected to an anode of the OLED. The fifth transistor T5 may selectively connect the second transistor T2 to the OLED.

Hereinafter, an example of an operation of the pixel 400 will be described below with reference to FIGS. 9 and 10.

As illustrated in FIG. 10, during a sensing period, the emission control signal SEM having a high level may be applied to the fifth transistor T5, and the fifth transistor T5 may be turned off in response to the emission control signal SEM having the high level. Accordingly, a current path may not be formed through a second transistor T2, and a degradation sensing operation and a temperature sensing operation may be accurately performed. An operation of the pixel 400 illustrated in FIG. 10 may be similar to an operation of the pixel 200 described with reference to FIG. 8, except that the fifth transistor T5 is turned off in response the emission control signal SEM instead of increasing a second power supply voltage ELVSS.

In a temperature sensing period within the sensing period, a temperature sensing voltage VTS applied to a data line DL may be provided to the temperature-dependent element 450 through the fourth transistor T4, and a current flowing through the temperature-dependent element 450 based on the temperature sensing voltage VTS may be measured through the data line DL. Further, in a degradation sensing period within the sensing period, a degradation sensing voltage VDS applied to the data line DL may be provided to the OLED through the third transistor T3, and a current flowing through the OLED based on the degradation sensing voltage VDS may be measured through the data line DL. In a display period after the sensing period, a degradation and temperature compensated data voltage VDATA may be stored in the capacitor C through the data line DL and the first transistor T1. The second transistor C may generate a driving current based on the degradation and temperature compensated data voltage VDATA, and the fifth transistor T5 may be turned on in response to the emission control signal SEM having a low level. Thus, the OLED may emit light based on the driving current corresponding to the degradation and temperature compensated data voltage VDATA. Accordingly, the pixel 400 may have a desired luminance, and thus an image quality of the OLED display device may be improved.

Figure 11:
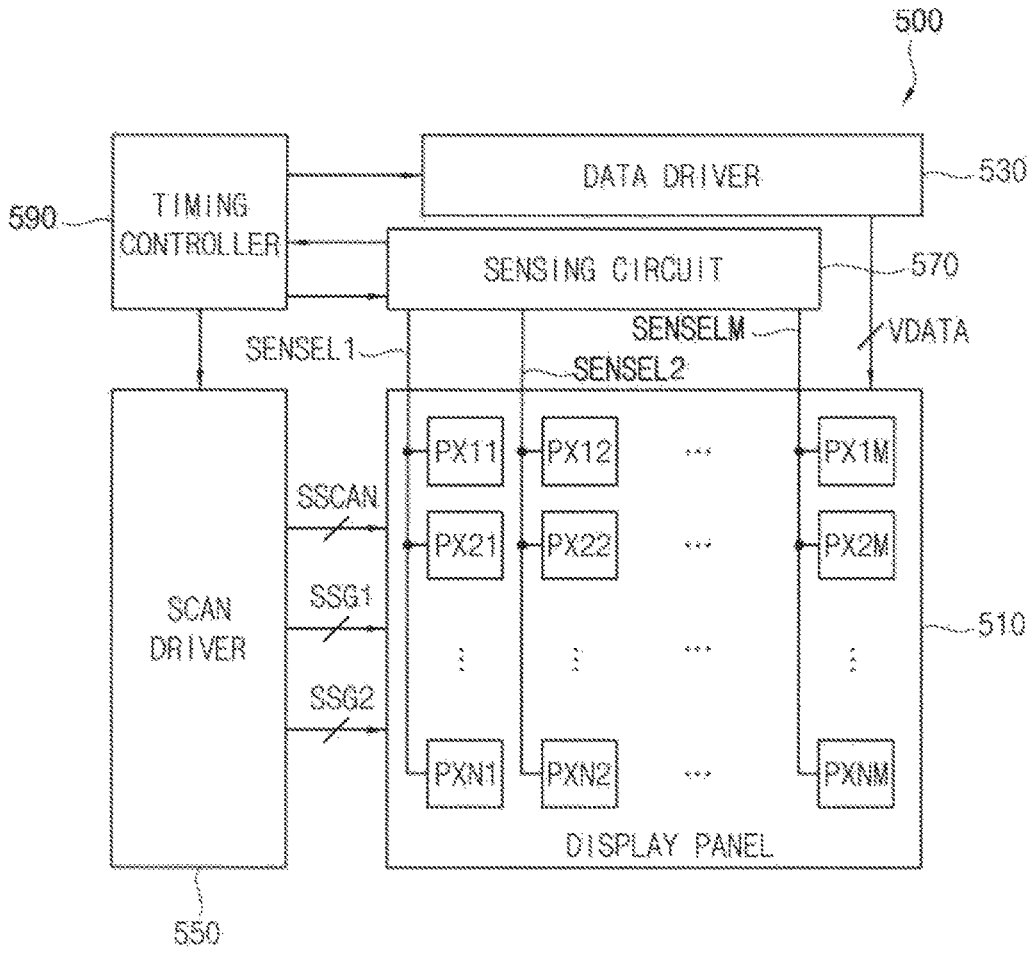
FIG. 11 is a block diagram illustrating an OLED display device according to example embodiments.
Figure 12:
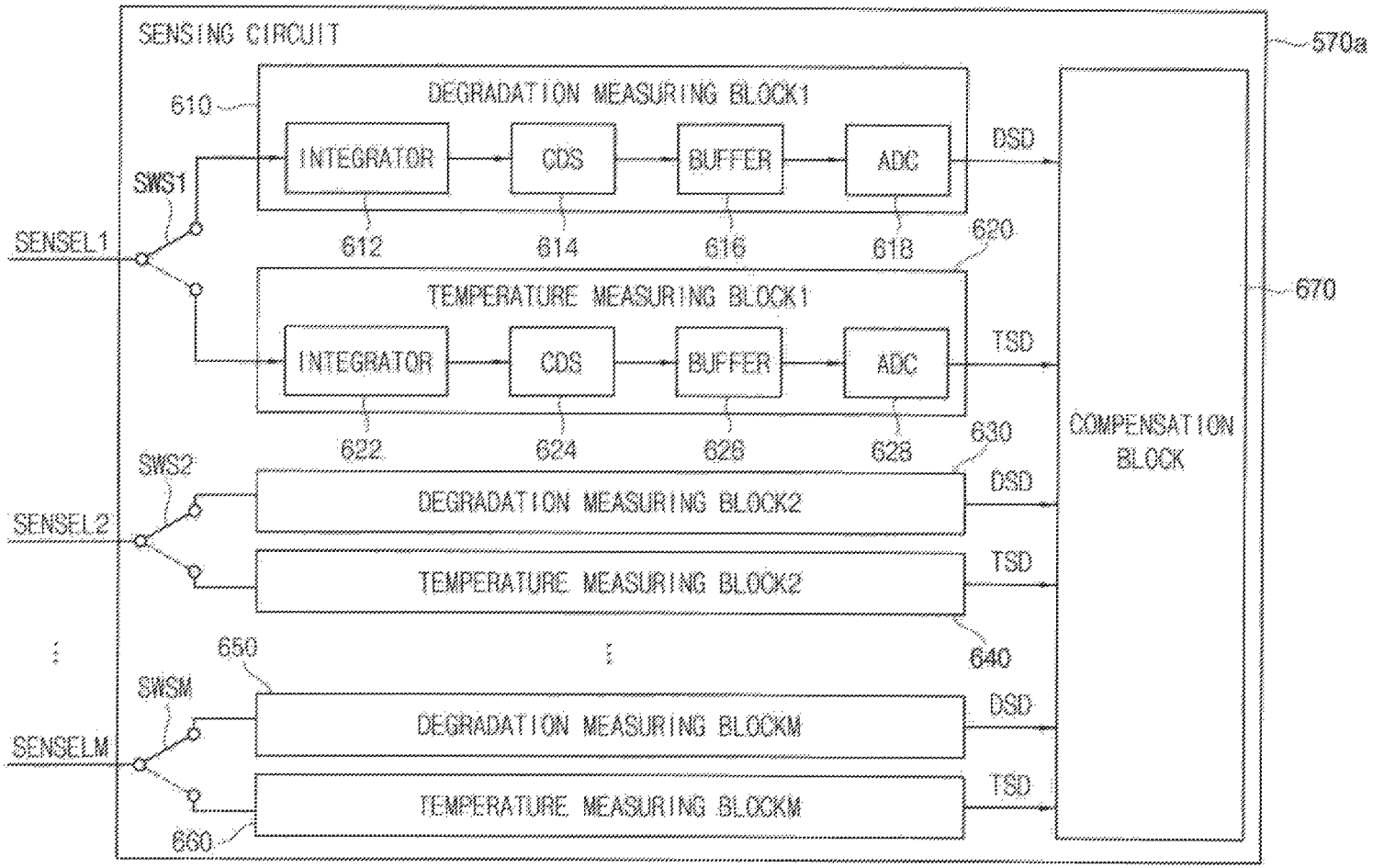
FIG. 12 is a block diagram illustrating an example of a sensing circuit included in an OLED display device according to example embodiments.
Figure 13:
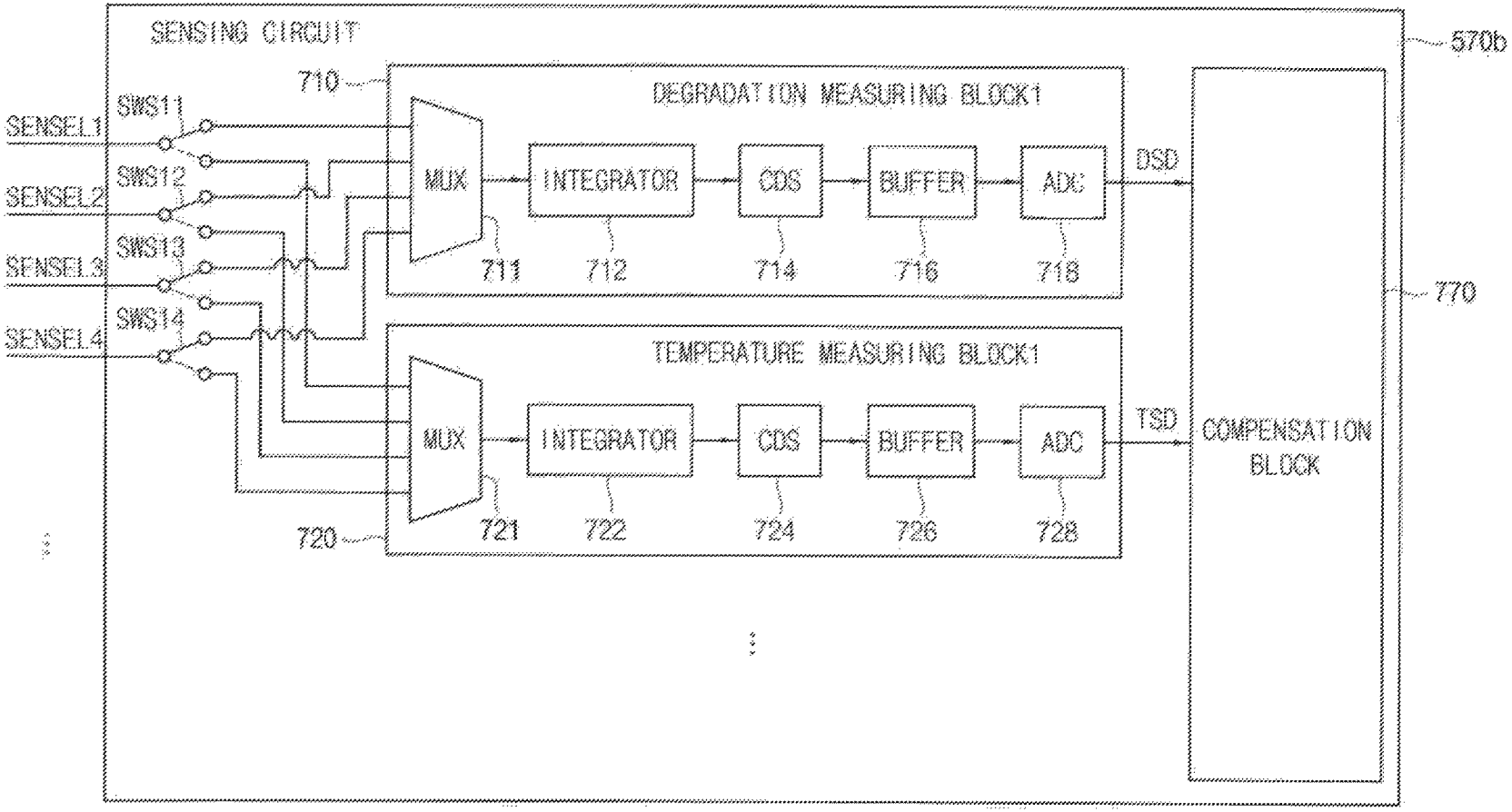
FIG. 13 is a block diagram illustrating another example of a sensing circuit included in an OLED display device according to example embodiments.

FIG. 11 is a block diagram illustrating an OLED display device according to example embodiments, FIG. 12 is a block diagram illustrating an example of a sensing circuit included in an OLED display device according to example embodiments, and FIG. 13 is a block diagram illustrating another example of a sensing circuit included in an OLED display device according to example embodiments.

Referring to FIG. 11, an OLED display device 500 includes a display panel 510 including a plurality of pixels PX11, PX12, PX1M, PX21, PX22, PX2M, PXN1, PXN2, and PXNM, a data driver 530 that provides a data voltage VDATA corresponding to image data to the pixels PX11, PX12, PX1M, PX21, PX22, PX2M, PXN1, PXN2, and PXNM, a scan driver 550 that provides a scan signal SSCAN, a first sensing gate signal SSG1, and a second sensing gate signal SSG2 to the pixels PX11, PX12, PX1M, PX21, PX22, PX2M, PXN1, PXN2, and PXNM, a sensing circuit 570 that performs a degradation sensing operation and a temperature sensing operation for the pixels PX11, PX12, PX1M, PX21, PX22, PX2M, PXN1, PXN2, and PXNM, and a timing controller 590 that controls the data driver 530, the scan driver 550, and the sensing circuit 570.

The display panel 510 may include the plurality of pixels PX11, PX12, PX1M, PX21, PX22, PX2M, PXN1, PXN2, and PXNM that are arranged in a matrix form. The plurality of pixels PX11, PX12, PX1M, PX21, PX22, PX2M, PXN1, PXN2, and PXNM may store the data voltage VDATA received from the data driver 530 in response to the scan signal SSCAN that is sequentially received from the scan driver 550 on a row by row basis, and may emit light based on the stored data voltage VDATA.

The plurality of pixels PX11, PX12, PX1M, PX21, PX22, PX2M, PXN1, PXN2, and PXNM may further receive the first and second sensing gate signals SSG1 and SSG2 from the scan driver 550. While the first and second sensing gate signals SSG1 and SSG2 are provided to the pixels PX11, PX12, PX1M, PX21, PX22, PX2M, PXN1, PXN2, and PXNM, the sensing circuit may perform the degradation sensing operation and the temperature sensing operation for the pixels PX11, PX12, PX1M, PX21, PX22, PX2M, PXN1, PXN2, and PXNM. Although FIG. 11 illustrates an example where the first and second sensing gate signals SSG1 and SSG2 are generated by the scan driver 550, in some example embodiments, the OLED display device 500 may further include another unit for generating the first and second sensing gate signals SSG1 and SSG2.

The sensing circuit 570 may perform the degradation sensing operation for all of the pixels PX11, PX12, PX1M, PX21, PX22, PX2M, PXN1, PXN2, and PXNM, or, alternatively, may perform the degradation sensing operation for a portion of the pixels PX11, PX12, PX1M, PX21, PX22, PX2M, PXN1, PXN2, and PXNM. In some example embodiments, each of the pixels PX11, PX12, PX1M, PX21, PX22, PX2M, PXN1, PXN2, and PXNM may include a temperature-dependent element, and the sensing circuit 570 may perform the temperature sensing operation for all of the pixels PX11, PX12, PX1M, PX21, PX22, PX2M, PXN1, PXN2, and PXNM using the temperature-dependent element. In other example embodiments, each of a portion of the pixels PX11, PX12, PX1M, PX21, PX22, PX2M, PXN1, PXN2 and PXNM may include the temperature-dependent element, and the sensing circuit 570 may perform the temperature sensing operation for the portion of the pixels PX11, PX12, PX1M, PX21, PX22, PX2M, PXN1, PXN2, and PXNM using the temperature-dependent element.

The sensing circuit 570 may include at least one degradation measuring block that measures, through sensing lines SENSEL1, SENSEL2, and SENSELM, currents flowing through OLEDs in the pixels PX11, PX12, PX1M, PX21, PX22, PX2M, PXN1, PXN2, and PXNM to sense degrees of degradation of the pixels PX11, PX12, PX1M, PX21, PX22, PX2M, PXN1, PXN2, and PXNM, and at least one temperature measuring block that measures, through the sensing lines SENSEL1, SENSEL2, and SENSELM, currents flowing through the temperature-dependent elements (or components) in the pixels PX11, PX12, PX1M, PX21, PX22, PX2M, PXN1, PXN2, and PXNM to sense temperatures of the pixels PX11, PX12, PX1M, PX21, PX22, PX2M, PXN1, PXN2, and PXNM.

In some example embodiments, as illustrated in FIG. 12, the sensing circuit 570*a* may include, per sensing line SENSEL1, SENSEL2, and SENSELM, one degradation measuring block 610, 630, and 650 and one temperature measuring block 620, 640, and 660. The sensing circuit 570*a* may further include switches SWS1, SWS2, and SWSM to selectively connect each sensing line SENSEL1, SENSEL2, and SENSELM to one of the degradation measuring blocks 610, 630, and 650 or the temperature measuring blocks 620, 640, and 660. The switches SWS1, SWS2, and SWSM may connect each sensing line SENSEL1, SENSEL2, and SENSELM to the degradation measuring block 610, 630, and 650, respectively, when the degradation sensing operation is performed, and may connect each sensing line SENSEL1, SENSEL2, and SENSELM to the temperature measuring block 620, 640, and 660, respectively, when the temperature sensing operation is performed.

For example, each degradation measuring block 610, 630, and 650 may include an integrator 612 that integrates a current received through the corresponding sensing line SENSEL1, SENSEL2, and SENSELM, a correlated double sampling (CDS) circuit 614 that removes a reset component from an integrated signal that is output from the integrator 612, a buffer 616 that temporarily stores an output of the CDS circuit 614, and an analog-to-digital conversion (ADC) circuit 618 that converts an output of the buffer 616 into degradation sensing data DSD that is a digital signal.

Each temperature measuring block 620, 640, and 660 may include an integrator 622 that integrates a current received through the corresponding sensing line SENSEL1, SENSEL2, and SENSELM, a CDS circuit 624 that removes a reset component from an integrated signal that is output from the integrator 622, a buffer 626 that temporarily stores an output of the CDS circuit 624, and an ADC circuit 628 that converts an output of the buffer 626 into temperature sensing data TSD that is a digital signal.

However, configurations of the degradation measuring blocks 610, 630, and 650 and the temperature measuring blocks 620, 640, and 660 are not limited to the configurations described above, and the degradation measuring blocks 610, 630, and 650 and the temperature measuring blocks 620, 640, and 660 may have various suitable configurations according to example embodiments. Although FIG. 12 illustrates an example where the degradation measuring blocks 610, 630, and 650 and the temperature measuring blocks 620, 640, and 660 are separate blocks, in some example embodiments, one measuring block may serve as both of the degradation measuring blocks 610, 630, and 650 and the temperature measuring blocks 620, 640, and 660.

In some example embodiments, the sensing circuit 570*a* may further include a compensation block 670 that adjusts image data for the pixels PX11, PX12, PX1M, PX21, PX22, PX2M, PXN1, PXN2, and PXNM based on the degradation sensing data DSD and the temperature sensing data TSD to compensate for the degradation and the temperature of the pixels PX11, PX12, PX1M, PX21, PX22, PX2M, PXN1, PXN2, and PXNM. For example, the compensation block 670 may provide, directly or through the timing controller 580, the data driver 530 with the image data that are adjusted to compensate for the degradation and the temperature, and the data driver 530 may apply the data voltage VDATA corresponding to the adjusted image data to the pixels PX11, PX12, PX1M, PX21, PX22, PX2M, PXN1, PXN2, and PXNM.

Although FIG. 11 illustrates an example where the sensing circuit 570 is separate from the data driver 530 and the timing controller 590, in some example embodiments, at least a portion of the sensing circuit 570 may be included in the data driver 530 and/or the timing controller 590. For example, the data driver 530 may include the sensing circuit 570. In another example, the compensation block 670 of the sensing circuit 570 or 570*a* may be implemented within the timing controller 590.

In other example embodiments, as illustrated in FIG. 13, the sensing circuit 570*b* may include one degradation measuring block 710 and one temperature measuring block 720 for a plurality of sensing lines SENSEL1, SENSEL2, SENSEL3, and SENSEL4. The sensing circuit 570*b* may further include switches SWS11, SWS12, SWS13, and SWS14 to selectively connect the sensing lines SENSEL1, SENSEL2, SENSEL3, and SENSEL4 to one of the degradation measuring block 710 or the temperature measuring block 720.

A first switch SWS1 may connect a first sensing line SENSEL1 to one of the degradation measuring block 710 or the temperature measuring block 720, a second switch SWS2 may connect a second sensing line SENSEL2 to one of the degradation measuring block 710 or the temperature measuring block 720, a third switch SWS3 may connect a third sensing line SENSEL3 to one of the degradation measuring block 710 or the temperature measuring block 720, and a fourth switch SWS4 may connect a fourth sensing line SENSEL4 to one of the degradation measuring block 710 or the temperature measuring block 720.

Each degradation measuring block 710 may include a multiplexer 711, an integrator 712, a CDS circuit 714, a buffer 716 and an ADC circuit 718. Compared with a degradation measuring block 610 illustrated in FIG. 12, the degradation measuring block 710 illustrated in FIG. 13 may further include the multiplexer 711. The multiplexer 711 may provide a selected one of the signals (e.g., currents flowing through OLEDs) received through the sensing lines SENSEL1, SENSEL2, SENSEL3, and SENSEL4 to the integrator 712.

Each temperature measuring block 720 may include a multiplexer 721, an integrator 722, a CDS circuit 724, a buffer 726 and an ADC circuit 728. Compared with a temperature measuring block 620 illustrated in FIG. 12, the temperature measuring block 720 illustrated in FIG. 13 may further include the multiplexer 721. The multiplexer 721 may provide a selected one of the signals (e.g., currents flowing through temperature-dependent elements) received through the sensing lines SENSEL1, SENSEL2, SENSEL3, and SENSEL4 to the integrator 722.

The sensing circuit 570*b* may further include a compensation block 770 that adjusts the image data based on the degradation sensing data DSD and the temperature sensing data TSD to compensate for the degradation and the temperature.

As described above, the OLED display device 500 according to example embodiments may sense not only the degradation of the pixels PX11, PX12, PX1M, PX21, PX22, PX2M, PXN1, PXN2, and PXNM but also the temperature of the pixels PX11, PX12, PX1M, PX21, PX22, PX2M, PXN1, PXN2, and PXNM. Accordingly, an accurate degradation and temperature compensation for each pixel PX11, PX12, PX1M, PX21, PX22, PX2M, PXN1, PXN2, and PXNM may be performed, and an image quality of the OLED display device 500 may be improved.

Figure 14:
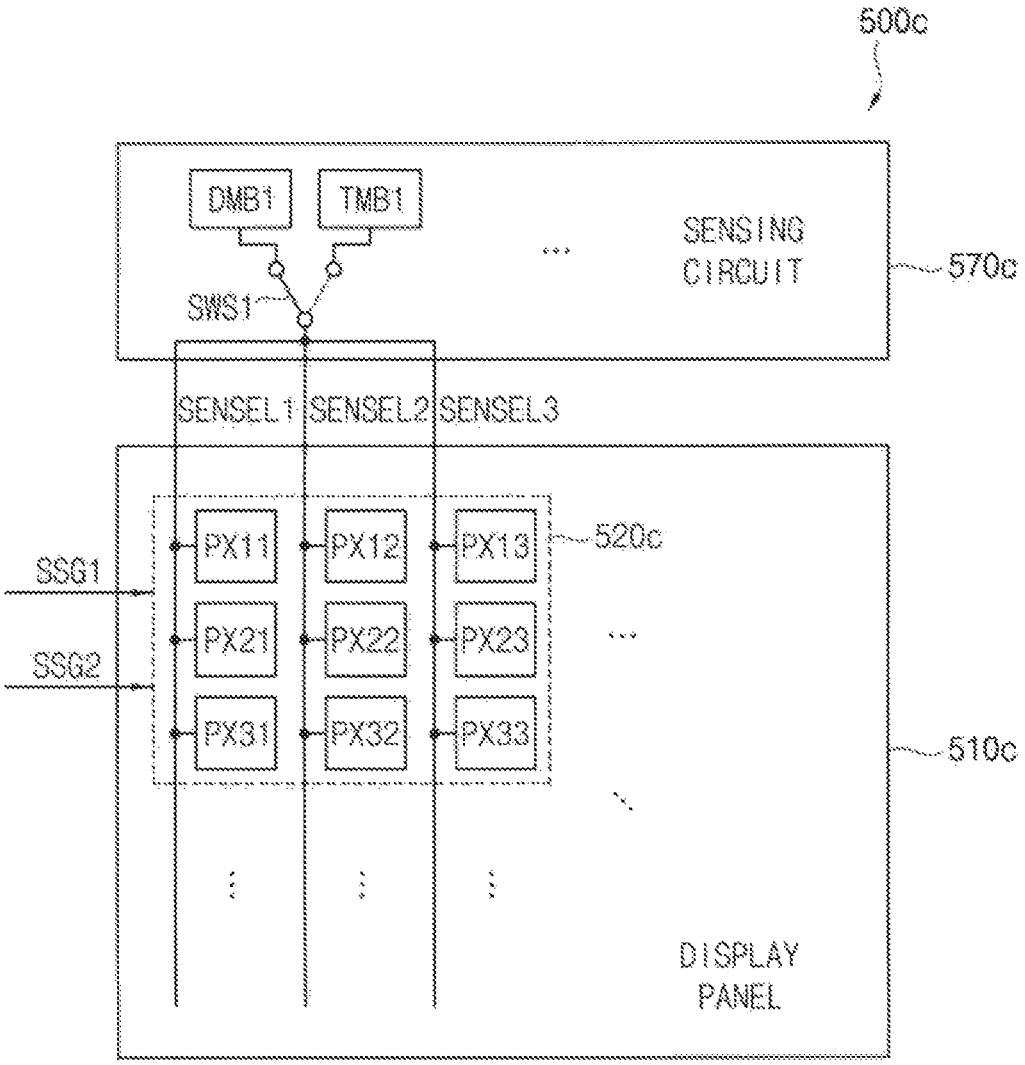
FIG. 14 is a diagram for illustrating an OLED display device where a temperature sensing operation is performed on a pixel group basis according to example embodiments.

FIG. 14 is a diagram for illustrating an OLED display device where a temperature sensing operation is performed on a pixel group basis according to example embodiments.

Referring to FIG. 14, a plurality of pixels PX11, PX12, PX13, PX21, PX22, PX23, PX31, PX32, and PX33 included in a display panel 510*c* of an OLED display device 500*c* may be grouped into a plurality of pixel groups 520*c*. Although FIG. 14 illustrates an example where each pixel group 520*c* includes nine pixels (i.e., 3-by-3 pixels) PX11, PX12, PX13, PX21, PX22, PX23, PX31, PX32, and PX33, a size of each of the pixel groups 520*c*, or the number of pixels in each of the pixel groups 520*c* may be varied according to example embodiments.

In the OLED display device 500*c*, temperature sensing operations (or degradation sensing operations) for the pixels PX11, PX12, PX13, PX21, PX22, PX23, PX31, PX32, and PX33 in each pixel group 520*c* may be concurrently (e.g., substantially simultaneously) performed. In some example embodiments, the same first sensing gate signal SSG1 may be applied to the pixels PX11, PX12, PX13, PX21, PX22, PX23, PX31, PX32, and PX33 in the pixel group 520*c*, and sensing lines SENSEL1, SENSEL2, and SENSEL3 connected to the pixels PX11, PX12, PX13, PX21, PX22, PX23, PX31, PX32, and PX33 may be connected to one node (e.g., through switches or directly).

A switch SWS1 of the sensing circuit 570*c* may connect the node to a degradation measuring block DMB1, and the degradation measuring block DMB1 may measure a sum of currents flowing through OLEDs in the pixels PX11, PX12, PX13, PX21, PX22, PX23, PX31, PX32, and PX33. Further, the same second sensing gate signal SSG2 may be applied to the pixels PX11, PX12, PX13, PX21, PX22, PX23, PX31, PX32, and PX33 in the pixel group 520*c*, the switch SWS1 of the sensing circuit 570*c* may connect the node to a temperature measuring block TMB1, and the temperature measuring block TMB1 may measure a sum of currents flowing through temperature-dependent elements (or components) in the pixels PX11, PX12, PX13, PX21, PX22, PX23, PX31, PX32, and PX33.

As described above, in the OLED display device 500*c*, the temperature sensing operation and/or the degradation sensing operation may be performed on a pixel group basis. Accordingly, a noise component caused by process variations among pixels may be reduced, and, even when the current output from each pixel is small, the sensing operations may be accurately performed based on the sum of currents from the pixels.

Figure 15:
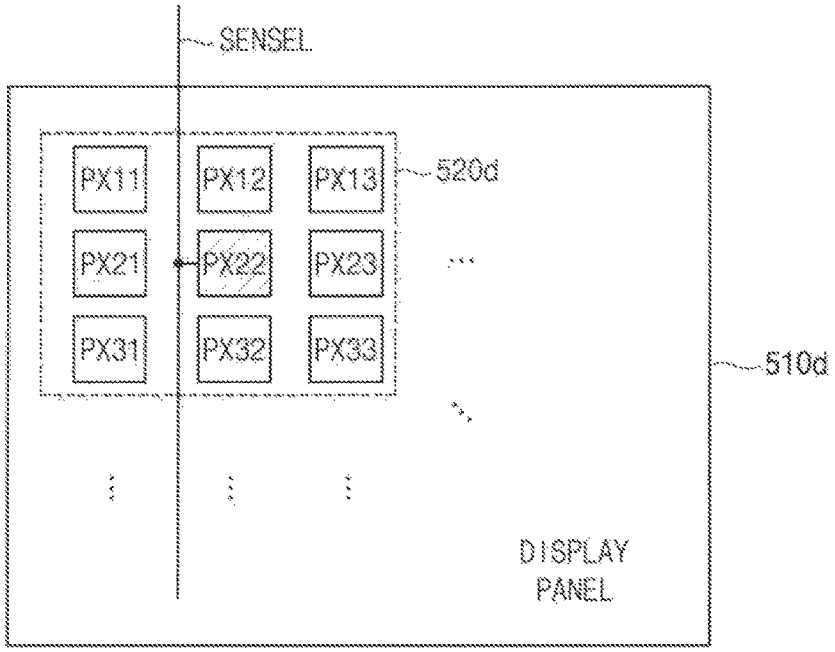
FIG. 15 is a diagram for illustrating an OLED display device where one pixel included in each pixel group includes a temperature-dependent element according to example embodiments.

FIG. 15 is a diagram for illustrating an OLED display device where one pixel included in each pixel group includes a temperature-dependent element according to example embodiments.

Referring to FIG. 15, a plurality of pixels PX11, PX12, PX13, PX21, PX22, PX23, PX31, PX32, and PX33 included in a display panel 510*d* of an OLED display device may be grouped into a plurality of pixel groups 520*d*.

In the OLED display device, only one pixel PX22 among the pixels PX11, PX12, PX13, PX21, PX22, PX23, PX31, PX32, and PX33 in each pixel group 520*d* may include a temperature-dependent element. In this case, a temperature sensed with respect to the one pixel PX22 may be applied to a compensation operation for other pixels PX11, PX12, PX13, PX21, PX23, PX31, PX32, and PX33 in the pixel group 520*d*. As described above, in the OLED display device, one pixel PX22 per pixel group 520*d* may include the temperature-dependent element. Accordingly, the number of temperature-dependent elements (or components) and/or the number of sensing lines included in the OLED display device may be reduced, and power consumption for performing the temperature sensing operation may be reduced.

Figure 16:
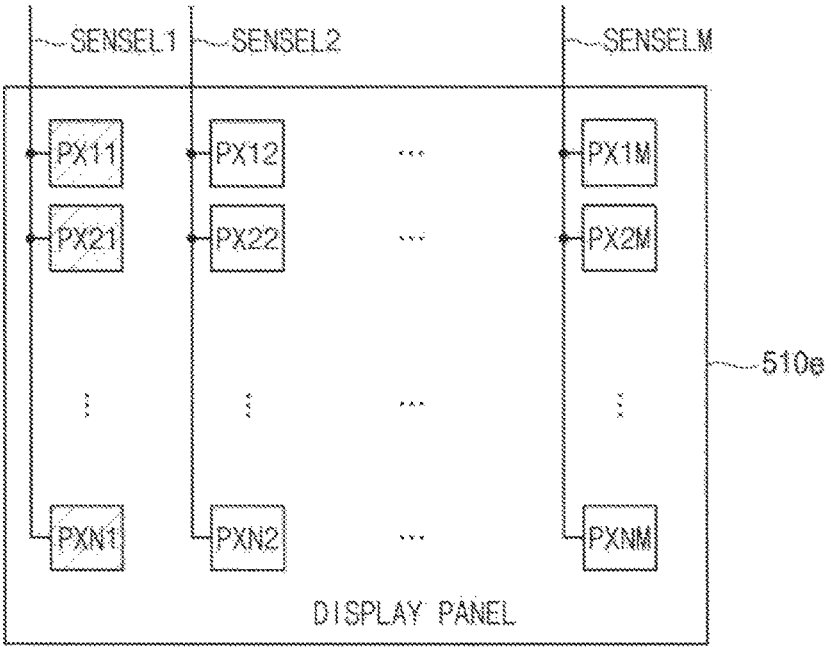
FIG. 16 is a diagram for illustrating an OLED display device in which a temperature sensing operation is performed on a portion of the pixels according to example embodiments when image data for a plurality of pixels indicate the same gray level.

FIG. 16 is a diagram for illustrating an OLED display device in which a temperature sensing operation is performed on a portion of the pixels included in a display panel 510*e* according to example embodiments when image data for a plurality of pixels indicate the same gray level.

Referring to FIG. 16, when image data for a plurality of pixels PX11, PX12, PX1M, PX21, PX22, PX2M, PXN1, PXN2, and PXNM indicate the same gray level (e.g., during a frame or a predetermined frame), a temperature sensing operation may be performed for a portion PX11, PX21, and PXN1 of the plurality of pixels PX11, PX12, PX1M, PX21, PX22, PX2M, PXN1, PXN2, and PXNM. For example, when the image data indicate the same gray level, the temperature sensing operation may be performed only for the pixels PX11, PX21, and PXN1 connected to a first sensing line SENSEL1 of sensing lines SENSEL1, SENSEL2 and SENSELM. In this case, the temperatures sensed with respect to the pixels PX11, PX21, and PXN1 connected to the first sensing line SENSEL1 may be applied to a compensation operation for other pixels PX12, PX1M, PX22, PX2M, PXN2, and PXNM. As described above, in the OLED display device, a temperature sensing operation may be performed only for some pixels PX11, PX21, and PXN1, and power consumption for performing the temperature sensing operation may be reduced.

Figure 17:
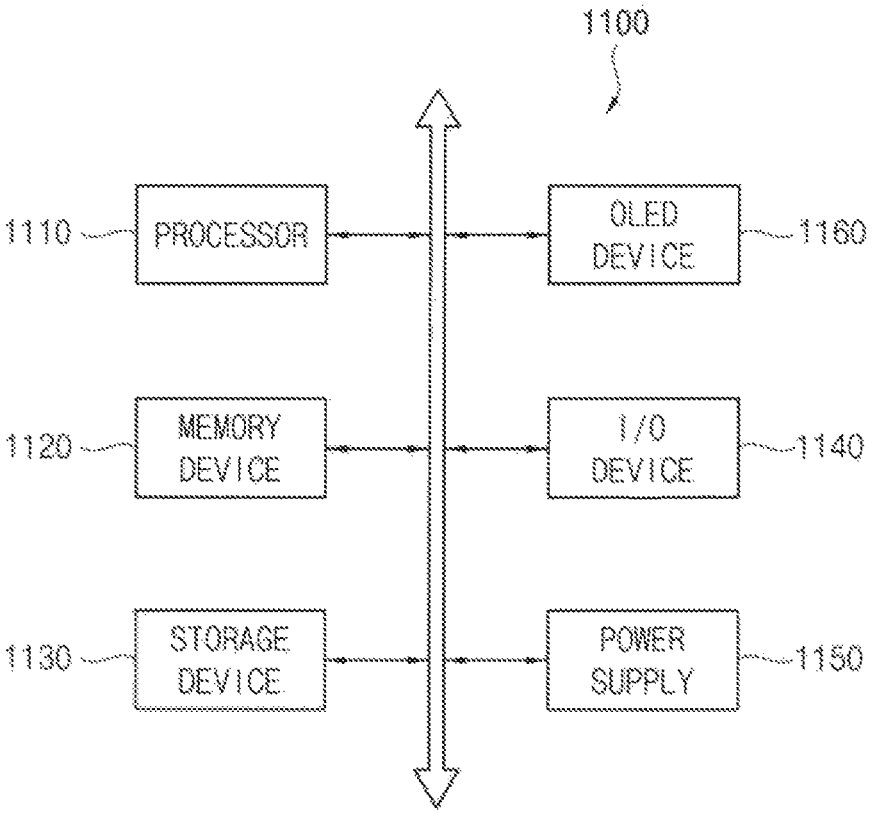
FIG. 17 is a block diagram illustrating an example of an electronic device according to example embodiments.

FIG. 17 is a block diagram illustrating an example of an electronic device according to example embodiments.

Referring to FIG. 17, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating (e.g., a video card, a sound card, a memory card, a universal serial bus (USB) device, other electric devices, etc.).

The processor 1110 may perform various computing functions. The processor 1110 may be an application processor (AP), a microprocessor, a central processing unit (CPU), etc. The processor 1110 may be coupled to other components via an address bus, a control bus, a data bus, etc. Further, in some example embodiments, the processor 1110 may further be coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive device, a hard disk drive device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100.

At least one pixel included in the OLED display device 1160 may include a temperature-dependent element of which a resistance is changed depending on a temperature of the pixel. The OLED display device 1160 may perform not only a degradation sensing operation for the pixel but also a temperature sensing operation for the pixel using the temperature-dependent element. Accordingly, the OLED display device 1160 may perform an accurate degradation and temperature compensation for each pixel.

According to example embodiments, the electronic device 1100 may be any electronic device including the OLED display device 1160, such as a cellular phone, a smart phone, a tablet computer, a wearable device, a personal digital assistant (PDA), a portable multimedia player (PMP), a digital camera, a music player, a portable game console, a navigation system, a digital television, a 3D television, a personal computer (PC), a home appliance, a laptop computer, etc.

A relevant device or component (or relevant devices or components) according to embodiments of the present invention described herein may be implemented utilizing any suitable hardware, firmware (e.g. an application-specific integrated circuit), software, or a suitable combination of software, firmware, and hardware. For example, the various components of the relevant device(s) may be formed on one integrated circuit (IC) chip or on separate IC chips. Further, the various components of the relevant device(s) may be implemented on a flexible printed circuit film, a tape carrier package (TCP), a printed circuit board (PCB), or formed on a same substrate as one or more circuits and/or other devices. Further, the various components of the relevant device(s) may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the spirit and scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the spirit and scope of the appended claims and their equivalents.

What is claimed is:

1. A pixel of an organic light emitting diode (OLED) display device, comprising:

a first transistor comprising a gate connected to a scan line, a first terminal connected to a data line, and a second terminal;

a capacitor comprising a first electrode connected to the second terminal of the first transistor and a second electrode connected to a first power supply voltage;

a second transistor comprising a gate connected to the first electrode of the capacitor, a first terminal connected to the first power supply voltage, and a second terminal;

an OLED comprising an anode connected to the second terminal of the second transistor and a cathode connected to a second power supply voltage;

a third transistor comprising a gate connected to a first sensing gate line, a first terminal connected to a sensing line, and a second terminal connected to the anode of the OLED;

a fourth transistor comprising a gate connected to a second sensing gate line, a first terminal connected to the sensing line, and a second terminal; and a temperature-dependent element connected to the second terminal of the fourth transistor, a resistance of the temperature-dependent element being changed depending on a temperature of the pixel, the temperature-dependent element being separate from the OLED, wherein the fourth transistor is configured to be turned on in response to a second sensing gate signal applied through the second sensing gate line, and while the fourth transistor is turned on a current flowing through the temperature-dependent element based on a temperature sensing voltage is applied to the sensing line to be measured during a temperature sensing period.

2. The pixel of claim 1, wherein the temperature-dependent element is a temperature-variable resistor of which a resistance increases as the temperature of the pixel increases.

3. The pixel of claim 1, wherein the temperature-dependent element is a temperature-dependent transistor of which a turn-on resistance increases as the temperature of the pixel increases.

4. The pixel of claim 1, wherein a magnitude of the current flowing through the temperature-dependent element depends on a temperature of the pixel.

5. The pixel of claim 1, wherein the temperature sensing period is in an emission period of a display frame.

6. The pixel of claim 1, wherein the temperature sensing period is in a sensing period separate from a display period.

7. A pixel of an organic light emitting diode (OLED) display device, comprising:

a first transistor comprising a gate connected to a scan line, a first terminal connected to a data line, and a second terminal;

a capacitor comprising a first electrode connected to the second terminal of the first transistor and a second electrode connected to a first power supply voltage;

a second transistor comprising a gate connected to the first electrode of the capacitor, a first terminal connected to the first power supply voltage, and a second terminal;

an OLED comprising an anode connected to the second terminal of the second transistor and a cathode connected to a second power supply voltage;

a third transistor comprising a gate connected to a first sensing gate line, a first terminal connected to a sensing line, and a second terminal connected to the anode of the OLED;

a fourth transistor comprising a gate connected to a second sensing gate line, a first terminal connected to the sensing line, and a second terminal; and a temperature-dependent element connected to the second terminal of the fourth transistor, a resistance of the temperature-dependent element being changed depending on a temperature of the pixel, the temperature-dependent element being separate from the OLED, wherein the third transistor is configured to be turned on in response to a first sensing gate signal applied through the first sensing gate line, and while the third transistor is turned on during a degradation sensing period a current flowing through the OLED is applied to the sensing line to be measured.

8. The pixel of claim 7, wherein a magnitude of the current flowing through the OLED depends on a degree of degradation of the pixel.

9. The pixel of claim 7, wherein the degradation sensing period is in an emission period of a display frame.

10. The pixel of claim 7, wherein the degradation sensing period is in a sensing period separate from a display period.

11. The pixel of claim 1, wherein the data line and the sensing line are different lines extending in parallel with each other.

12. The pixel of claim 1, wherein the data line and the sensing line are a same line.

13. The pixel of claim 1, wherein the second transistor is configured to be turned off when a black data voltage, applied to the data line, is stored in the capacitor through the first transistor in a sensing period.

14. The pixel of claim 13, wherein the fourth transistor is configured to provide a temperature sensing voltage, applied to the sensing line, to the temperature-dependent element during a temperature sensing period within the sensing period, and a current flowing through the temperature-dependent element, based on the temperature sensing voltage, is applied to the sensing line to be measured.

15. The pixel of claim 13, wherein the third transistor is configured to provide a degradation sensing voltage, applied to the sensing line, to the OLED during a degradation sensing period within the sensing period, and a current flowing through the OLED, based on the degradation sensing voltage, is applied to the sensing line to be measured.

16. The pixel of claim 1, wherein at least one of the first power supply voltage or the second power supply voltage is adjusted such that the first power supply voltage and the second power supply voltage have substantially the same voltage level during a sensing period.

17. The pixel of claim 1, further comprising a fifth transistor comprising:

a gate for receiving an emission control signal, a first terminal connected to the second terminal of the second transistor, and a second terminal connected to the anode of the OLED.

18. The pixel of claim 17, wherein the fifth transistor is configured to be turned off in response to the emission control signal having a set voltage level during a sensing period.

19. An organic light emitting diode (OLED) display device comprising a plurality of pixels, at least one pixel of the plurality of pixels comprising:

a first transistor comprising a gate connected to a scan line, a first terminal connected to a data line, and a second terminal;

a capacitor comprising a first electrode connected to the second terminal of the first transistor and a second electrode connected to a first power supply voltage;

a second transistor comprising a gate connected to the first electrode of the capacitor, a first terminal connected to the first power supply voltage, and a second terminal;

an OLED comprising an anode connected to the second terminal of the second transistor and a cathode connected to a second power supply voltage;

a third transistor comprising a gate connected to a first sensing gate line, a first terminal connected to a sensing line, and a second terminal connected to the anode of the OLED;

a fourth transistor comprising a gate connected to a second sensing gate line, a first terminal connected to the sensing line, and a second terminal; and a temperature-dependent element connected to the second terminal of the fourth transistor, a resistance of the temperature-dependent element being changed depending on a temperature of the at least one pixel, the temperature-dependent element being separate from the OLED, wherein the OLED display device further comprises a sensing circuit configured to sense a degree of degradation of the at least one pixel by measuring a current flowing through the OLED and to sense the temperature of the at least one pixel by measuring a current flowing through the temperature-dependent element.

20. The OLED display device of claim 19, wherein a portion of the plurality of pixels comprise the temperature-dependent element.

21. The OLED display device of claim 19, wherein the sensing circuit is configured to adjust image data for the at least one pixel based on the sensed degree of degradation and the sensed temperature to compensate for the degradation and the temperature of the at least one pixel.

22. The OLED display device of claim 19, wherein the plurality of pixels are grouped into a plurality of pixel groups, and one of the plurality of pixels in each of the pixel groups comprises the temperature-dependent element.

23. The OLED display device of claim 19, wherein the plurality of pixels are grouped into a plurality of pixel groups, and a temperature sensing operation for the plurality of pixels in each of the pixel groups is concurrently performed.

24. The OLED display device of claim 19, wherein a temperature sensing operation is performed for a portion of the plurality of pixels when image data for the plurality of pixels has the same gray level.

* * * * *